US009831607B2

(12) United States Patent
Laurx et al.

(10) Patent No.: US 9,831,607 B2
(45) Date of Patent: Nov. 28, 2017

(54) CONNECTOR AND SYSTEM WITH SHORT SIGNAL PINS

(71) Applicant: Molex, LLC, Lisle, IL (US)

(72) Inventors: John C. Laurx, Aurora, IL (US); Vivek M. Shah, Buffalo Grove, IL (US); Chien-Lin Wang, Naperville, IL (US); Peerouz Amleshi, Lisle, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/060,781

(22) Filed: Mar. 4, 2016

(65) Prior Publication Data

US 2016/0261075 A1 Sep. 8, 2016

Related U.S. Application Data

(60) Provisional application No. 62/129,414, filed on Mar. 6, 2015.

(51) Int. Cl.
*H01R 13/648* (2006.01)
*H01R 13/6471* (2011.01)
*H01R 12/58* (2011.01)

(52) U.S. Cl.
CPC ..... *H01R 13/6471* (2013.01); *H01R 12/585* (2013.01)

(58) Field of Classification Search
CPC ..... H01R 12/585; H01R 12/58; H01R 12/716
See application file for complete search history.

(56) References Cited

U.S. PATENT DOCUMENTS 6,593,535 B2 * 7/2003 Gailus ..... H01R 12/523 174/255
6,716,068 B2 4/2004 Wu
7,988,457 B1 * 8/2011 Morgan ..... H01R 12/724 439/65
8,715,006 B2 * 5/2014 Jeon ..... H01R 12/585 439/607.1
2012/0302075 A1 11/2012 Muraoka et al.

FOREIGN PATENT DOCUMENTS

TW M267672 U 6/2005

* cited by examiner

*Primary Examiner* — Xuong Chung Trans
(74) *Attorney, Agent, or Firm* — Jeffrey K. Jacobs

(57) ABSTRACT

A connector system includes a connector mounted on a circuit board. The circuit board has deeper backdrilled vias and the connector has modified signal terminal that can mate with the backdrilled vias so as to provide a surprising increase in the performance of signal traces provided in the top layers of the circuit board.

9 Claims, 10 Drawing Sheets

CONNECTOR AND SYSTEM WITH SHORT SIGNAL PINS

RELATED APPLICATIONS

This application claims priority to U.S. Provisional Application No. 62/129,414, filed Mar. 6, 2015, which is incorporated herein by reference in its entirety.

TECHNICAL FIELD

This disclosure relates to the field of connectors, more specifically to the field of press-fit connectors suitable for high data rates.

DESCRIPTION OF RELATED ART

FIG. 1 illustrates a state of the art backplane/connector interface for a press-fit connector and shall be used as the basis for Config #1 in the charts provided in FIGS. 5-9. As depicted, the ground terminal tails 59 and signal terminal tails 58 are configured to extend into a circuit board 60 about 1.3 mm. Making the terminals tails this small has proven beneficial from a performance standpoint in spite of the challenges that result from the assembly process. To improve performance the via can be backdrilled so that the resulting via extends about 1.0 mm into the circuit board 60. This provides improved performance compared to prior designs but as data rates have increased from 25 to 40 Gbps there is a desire to further improve the connector design. One issue that exists with the move to 40 Gbps channel (which relies on 20 Ghz signaling in an NRZ encoding system) is that the vias and terminals create a substantial stub if signal traces 62 are attempted to be used in the second or third layer of the circuit board, thus it is common to not use the second or third layer as a high data rate capable channel and instead place several extra layers on top of uppermost high data rate capable signal layer. Due to the desire to have symmetrical construction in the circuit board 50 (otherwise the circuit board tends to warp) this tends to require the addition of four or six additional layers on the circuit board (the layers added on top are also added on the bottom), which can increase the cost of the circuit board 60. Thus, certain individuals would appreciate further improvements to connector and circuit boards to enable lower cost solutions and improved performance.

SUMMARY

A system provides a connector mounted on a circuit board. The circuit board includes a top surface and includes a plurality of ground vias and signal vias. The signal vias can be backdrilled so that the signal via doesn't extends more than about 0.3 mm past the trace connected to the signal via and in an embodiment the signal via can extend down 0.5 mm from the top surface. The connector includes ground terminal tails positioned in the ground via and signal terminal tails positioned in the signal vias. The signal terminal tails include an enlarged portion that extends into the board not more than 0.5 mm and thus can engage the shorter signal via but the total length of the signal terminal tail can still extend into the circuit board as far as the ground terminal tail.

BRIEF DESCRIPTION OF THE DRAWINGS

The present invention is illustrated by way of example and not limited in the accompanying figures in which like reference numerals indicate similar elements and in which.

DETAILED DESCRIPTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

It should be noted that the details of the connector are not shown herein. The disclosure provided herein is suitable for use with a variety of connector types that are configured to provide high data-rate capable connectors and one potential application is a backplane connector such as the MOLEX IMPEL connector family. Another potential application is a standard input/output (I/O) style connector such as the MOLEX zQSFP stacked connectors. In each case the connector could be modified to include signal tails as described herein to obtain benefits at higher signaling frequencies and data rates.

Figure 2:
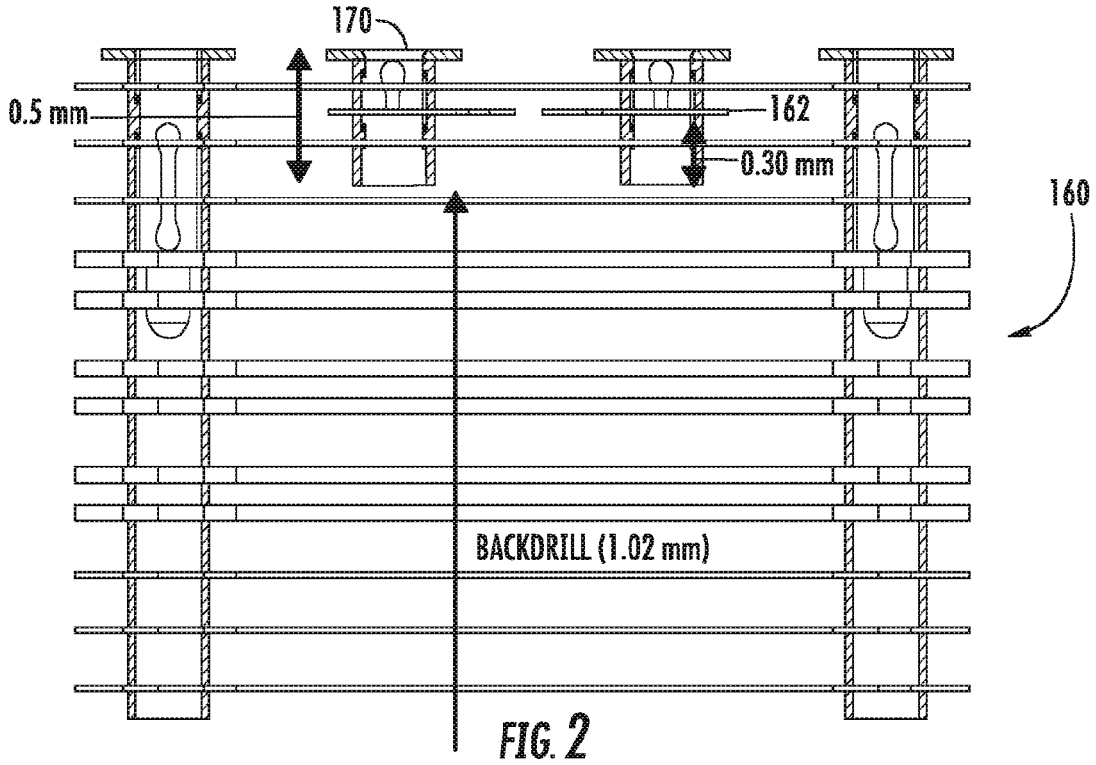
FIG. 2 illustrates a simplified cross section of exemplary embodiment of a connector system with a very short via and terminal configuration.

As noted above, the current state of the art is problematic at 20 GHz signaling frequencies for signal rows in the top two or three layers. One potential solution is to just make the terminal tails very short, such as is illustrated in FIG. 2. Applicants have determined that a signal tail that does not extend into the board more than 0.5 mm, in combination with a via barrel that is about 0.5 mm long, will have very good performance in a configuration where the top three layers include the high data-rate capable signal traces and this theoretical solution is the basis for Config. #3.

Figure 1:
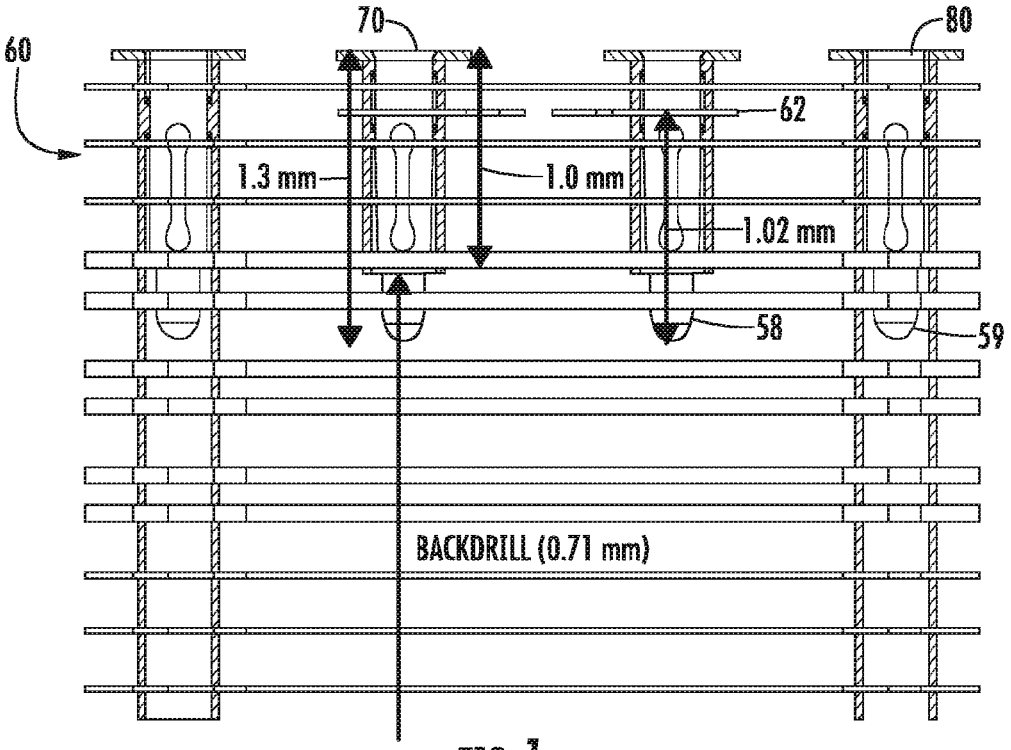
FIG. 1 (PRIOR ART)
FIG. 1 illustrates a simplified cross section of a prior art design of a connector system.

The solution in Config. #3, however, is problematic from an assembly process as it becomes very difficult to align the terminal tails with the vias once the tails become so short. In addition, the short tails tend to have much lower retention force, thus making the resulting solution undesirable from a robustness standpoint, at least without additional retention features. Consequentially persons of skill have been dissuaded from attempting to use an eye-of-the-needle style tail shorter than about 1 mm length and the depicted designs use terminals that are configured to extend into the circuit board between 1 and 1.4 mm in length, with the terminals in FIG. 1-3 being configured to extend into the circuit board about 1.3 mm.

Figure 3:
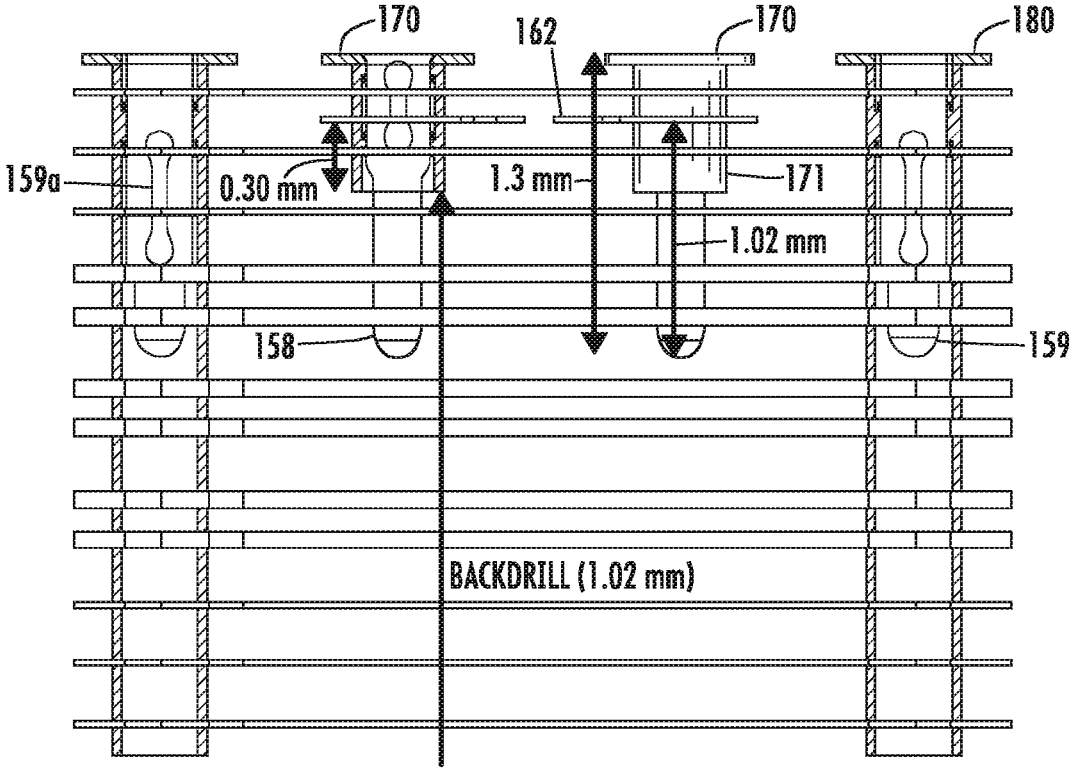
FIG. 3 illustrates a simplified cross section of another exemplary embodiment of a connector system with short vias and longer terminals.
Figure 4:
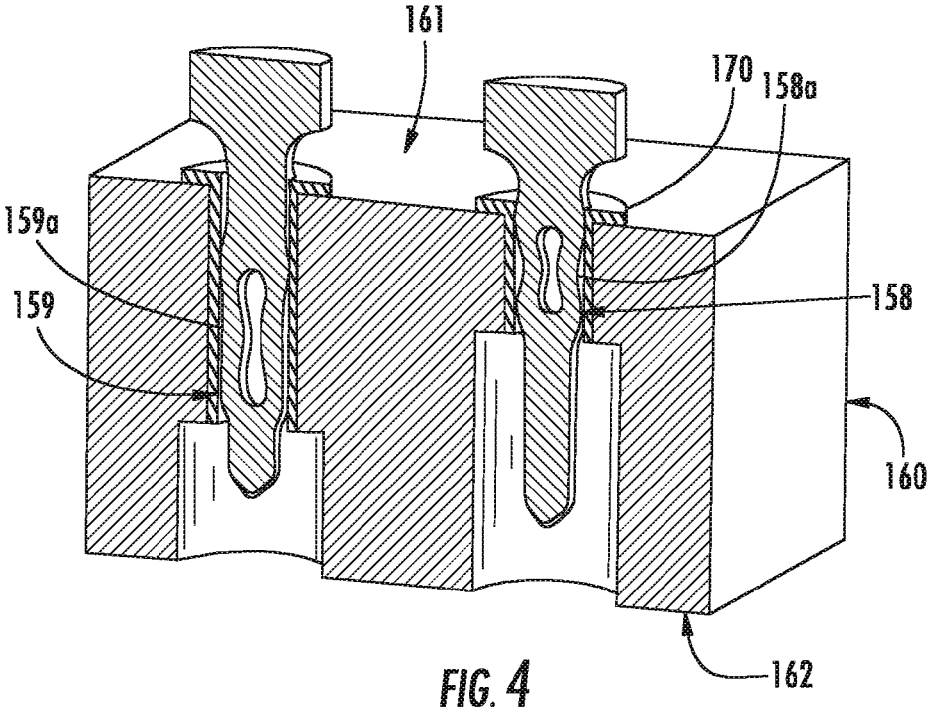
FIG. 4 illustrates a perspective view of a cross section of a circuit board showing two via and terminal configurations.
Figure 5:
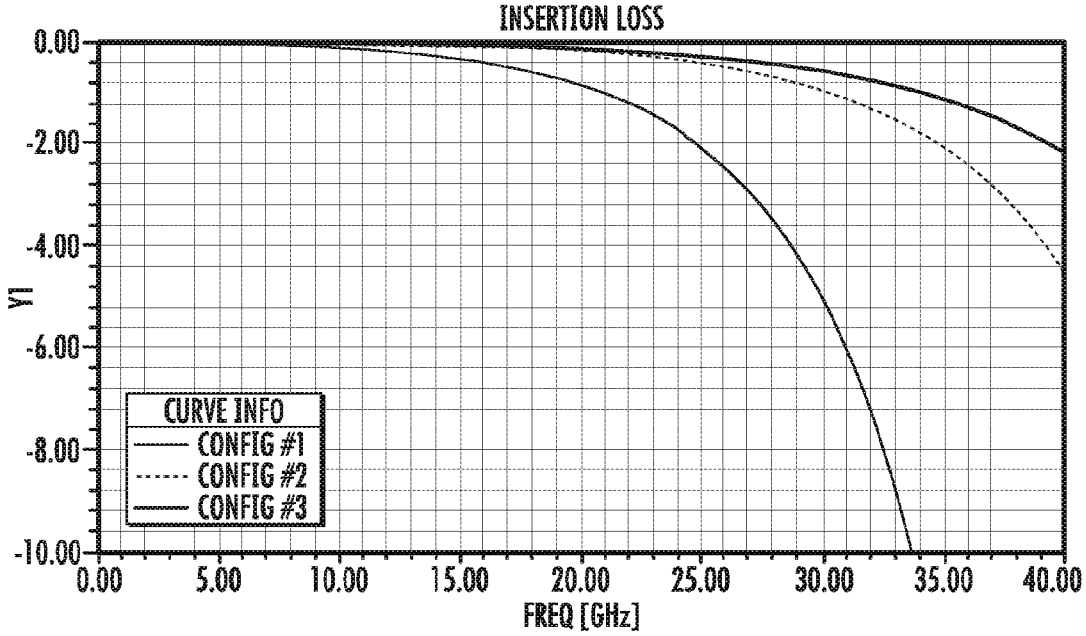
FIG. 5 illustrates a graph of insertion loss performance of the configurations depicted in FIG. 1, FIG. 2 and FIG. 3.
Figure 6:
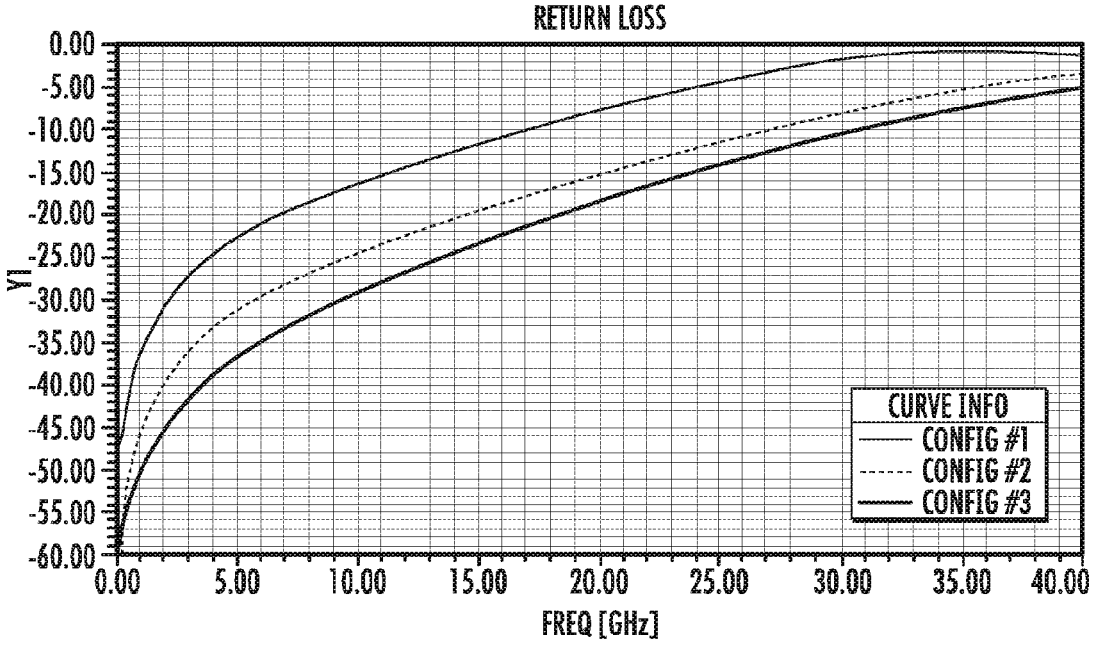
FIG. 6 illustrates a graph of return loss performance of the configurations depicted in FIG. 1, FIG. 2 and FIG. 3.
Figure 7:
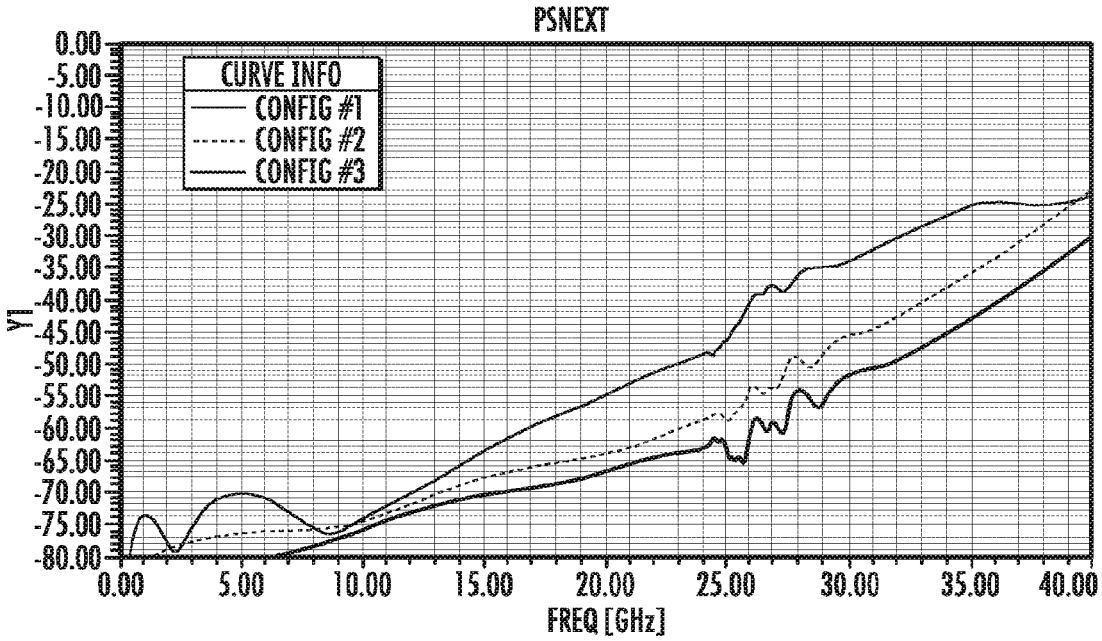
FIG. 7 illustrates a graph of near-end cross talk of the configurations depicted in FIG. 1, FIG. 2 and FIG. 3.
Figure 8:
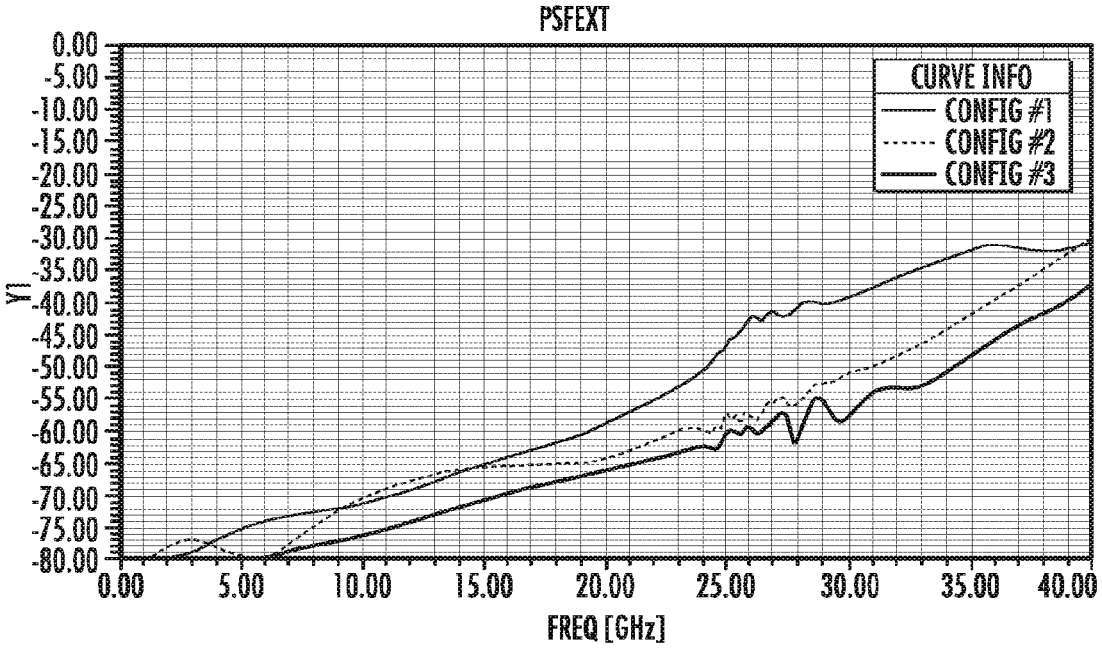
FIG. 8 illustrates a graph of far-end cross talk of the configurations depicted in FIG. 1, FIG. 2 and FIG. 3.
Figure 9:
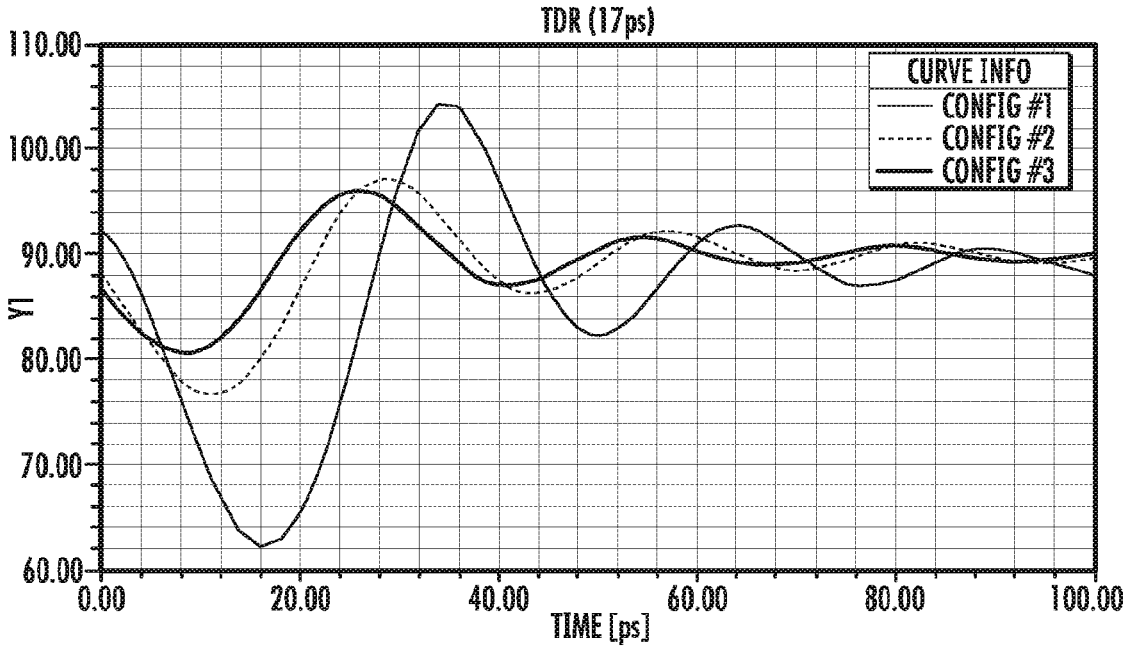
FIG. 9 illustrates a graph of impedance response of the configurations depicted in FIG. 1, FIG. 2 and FIG. 3.

FIGS. 3-4 illustrate an alternative embodiment of a connector system that surprisingly has been found to work much better than expected. A circuit board 160 with a top surface 161 and a bottom surface 162 is provided with a plurality of signal vias 170 and ground vias 180. Ground terminal tails 158 are positioned in the ground vias 180 while signal terminal tails 158 are positioned in the signal vias.

As depicted, the ground terminals 159 are configured so that the enlarged portion 159*a* (e.g., the eye in an "eye of the needle" design) is positioned in the circuit board a substantial distance so as to provide good retention and in the depicted embodiments the top of the enlarged portion is more than 0.2 mm into the circuit board 160. This helps provide good retention of the ground terminal tails 159 in the circuit board 160 and improves the robustness of the system. To aid in installation the ground terminal tails are configured to extend about 1.3 mm into the circuit board because, as noted above, shorter tails are difficult to position in the vias.

The signal terminal tails 158 are also configured to extend about 1.3 mm into the circuit board 160 but are configured so that the enlarged portion 158*a* extends into the circuit board not more than 0.5 mm. In addition, the signal vias are backdrilled so that the via 170 only extends about 0.3 mm past the trace, which could be about 0.5 mm into the circuit board 160 for traces near the top surface of the circuit board 160 (in that regard, the signal vias are similar to the configuration depicted in FIG. 2). This provides an embodiment where the via 170, once backdrilled, does to not extend more than 0.30 mm past the signal trace 162 and (for traces near the top surface 161) also does not extend more than 0.5 mm below the top surface 161. In other words, the signal terminal tails 158 are configured so that the lowest part of the enlarged portion 158*a* does not extend more than about 0.5 mm into the circuit board 160 while the tail still extends further into the board and preferably extends more than 1.0 mm into the board.

As can be appreciated, therefore, the signal terminal tails 158 can extend more than 0.5 mm past the backdrilled via 170 and in the depicted embodiment extend 0.8 mm past the via barrel 170. The signal tails could be shortened somewhat to provide further improvements but shorter tails provides diminishing returns that must be balanced with the desire for reliable assembly. In that regard it should be noted that having the signal terminal tails substantially the same length as the ground terminal tails is beneficial in insuring all the terminals are properly seated in their respective vias before the connector is pressed onto the board. And for retention purposes it is desirable to have the ground terminals with an enlarged portion that is reliably below the top surface so that a reliable engagement between the connector and the circuit board.

The depicted configuration also allows the signal terminal tails 158 to be inserted into their respective vias prior to having the enlarged portion 159*a* of the ground terminal tails 159 start to be compressed. This helps provide better tactile feedback and reduces the chance that the signal tails could be misaligned and inadvertently damaged/crushed due to the difficulty in perceiving the misalignment because of the higher efforts associated with compressing the enlarged portions 159*a*. Another advantage of the depicted system is that the maximum insertion force of the tails can be reduced due to the fact that the enlarged portions 159*a* are finished being compressed before the enlarged portions 158*a* start to get compressed. In other words, the enlarged portions of the terminals are compressed in a sequenced manner with the ground terminal tails being compressed first and the signal terminals tails being compressed second. This configuration is Config. #2 and as can be appreciated, the performance of this system is close to the performance of the theoretical design illustrated in FIG. 2, especially at 20 GHz.

It should be noted that the backdrill is shown as being 0.7 mm in diameter and can also be as large as about 1.0 mm in diameter. While it is beneficial to increase the backdrill diameter from about 0.5 mm to about 0.7 mm, Applicants have determined that there are decreasing returns as the backdrill diameter is increased beyond about 0.7 mm. Therefore for most solutions it is expect that it will be more desirable to use a backdrill diameter of about 0.7 mm.

Turning to FIGS. 5-9, the performance of signal terminals tails in the Config. #2 configuration is illustrated. As can be appreciated, compared to standard terminals, the Config. #2 design provides a substantial improvement that would readily support 20 GHz signaling while providing at channel that has almost 15 dB of signal between the insertion loss and return loss. In contrast, the prior design only had about 11 dB of signal at 15 GHz and, therefore, in the prior design the signal traces in the top layers would not have been suitable to support a 40 Gbps channel. Thus the improved design enables 40 Gbps performance in layers that previously were not functional at such data rates and provides the possibility of reduced costs.

It should be noted that the depicted designs are connectors with terminals configured to engage vias that are about 0.40 mm in diameter. The features described herein are also effective for slightly larger tails and vias, such as a system where the tails are configured to engage vias that have about a 0.45 mm diameter.

Figure 10:
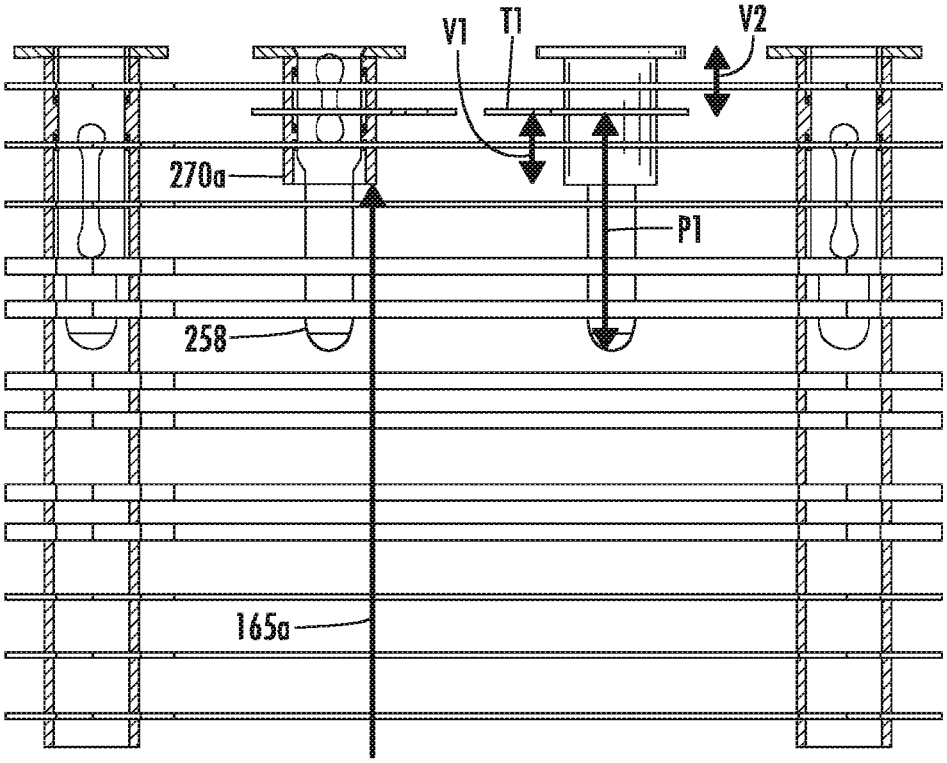
FIG. 10 illustrates a simplified cross section of exemplary embodiment of a connector system with a via connected to a trace in a L3 layer.
Figure 11:
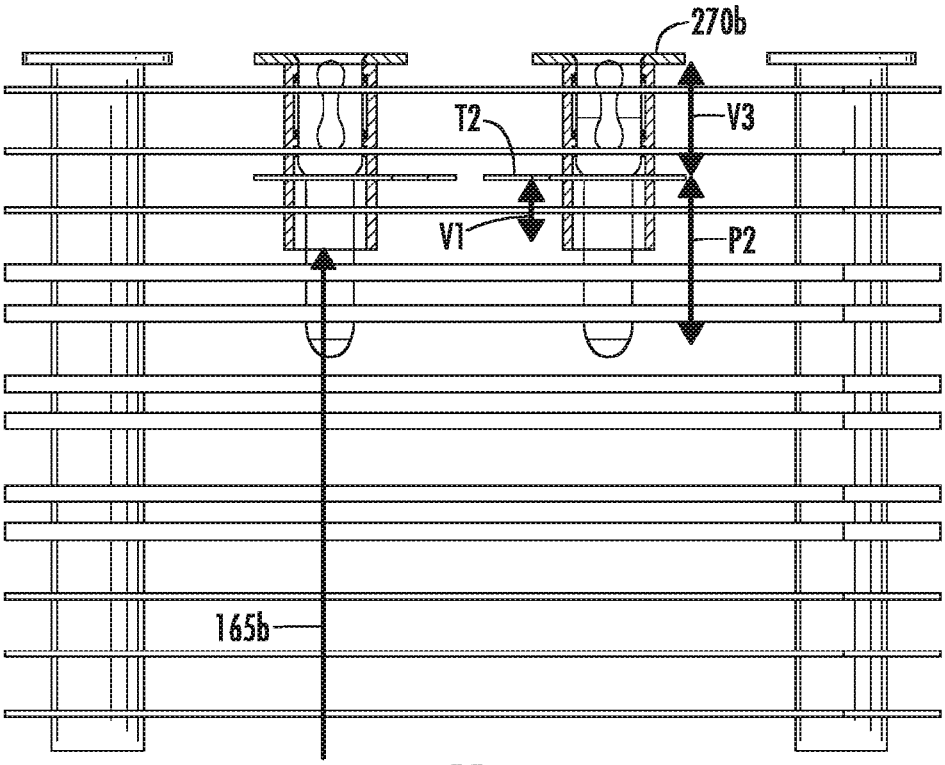
FIG. 11 illustrates a simplified cross section of exemplary embodiment of a connector system with a via connected to a trace in a L5 layer.
Figure 12:
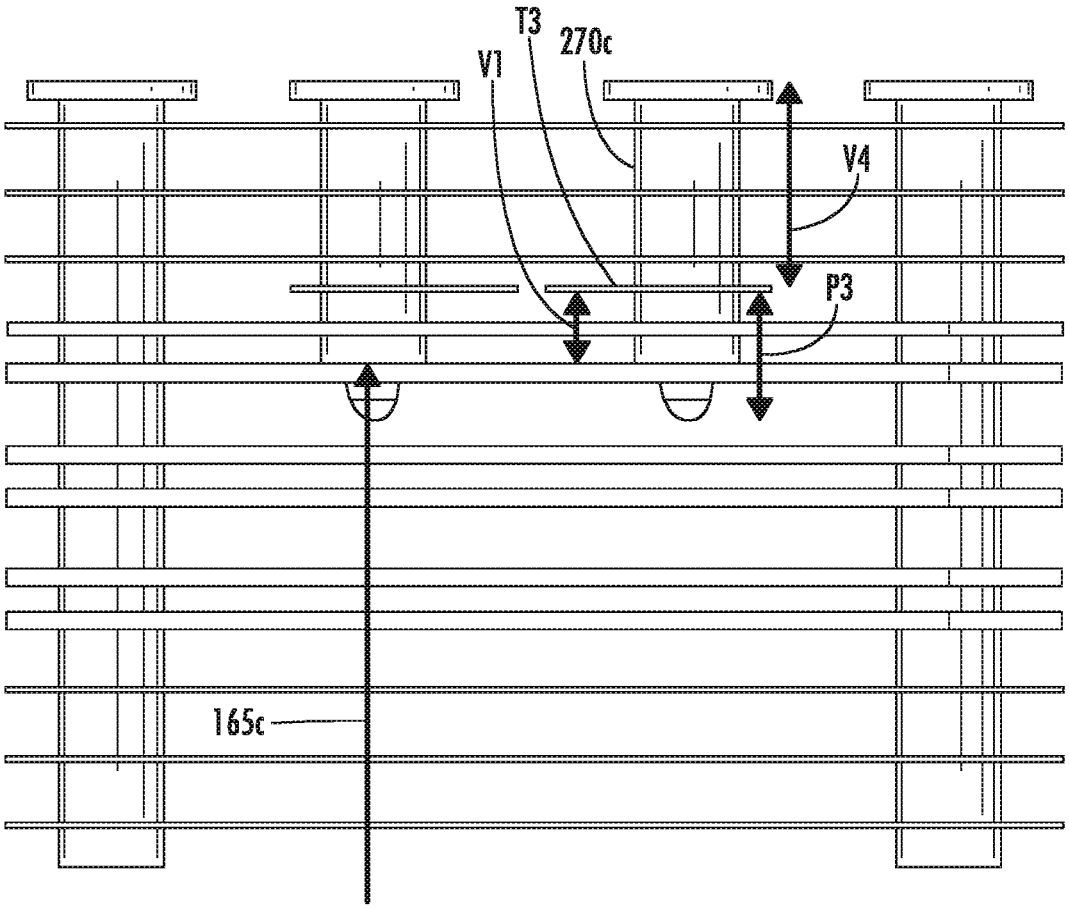
FIG. 12 illustrates a simplified cross section of exemplary embodiment of a connector system with a via connected to a trace in a L7 layer.
Figure 13:
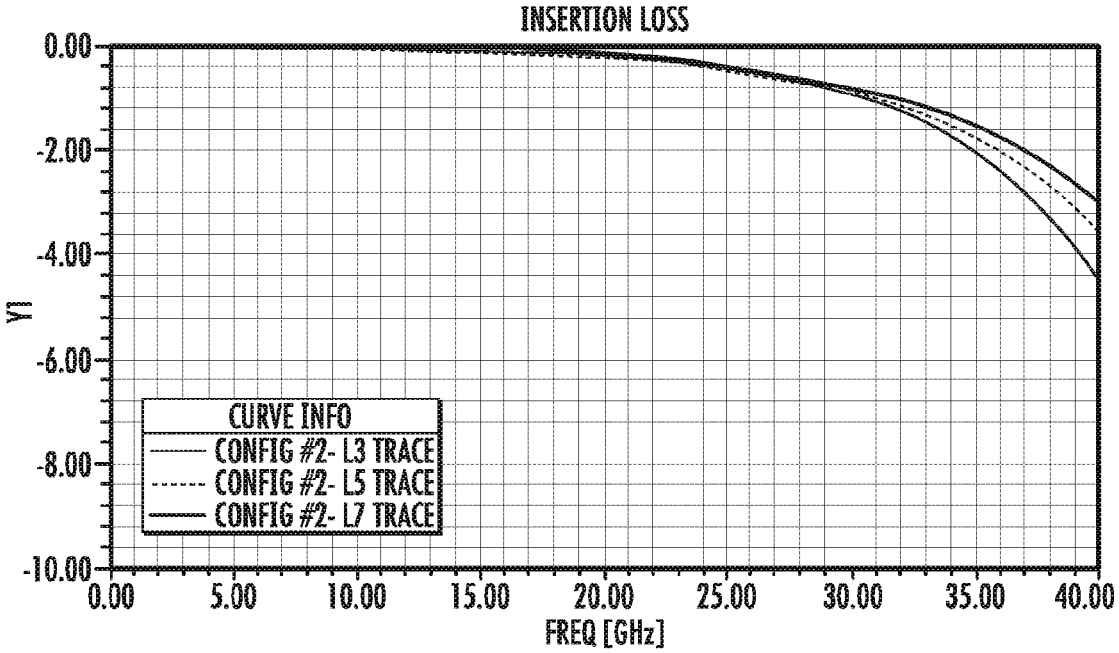
FIG. 13 illustrates a graph of insertion loss performance of the configurations depicted in FIG. 10, FIG. 11 and FIG. 12.
Figure 14:
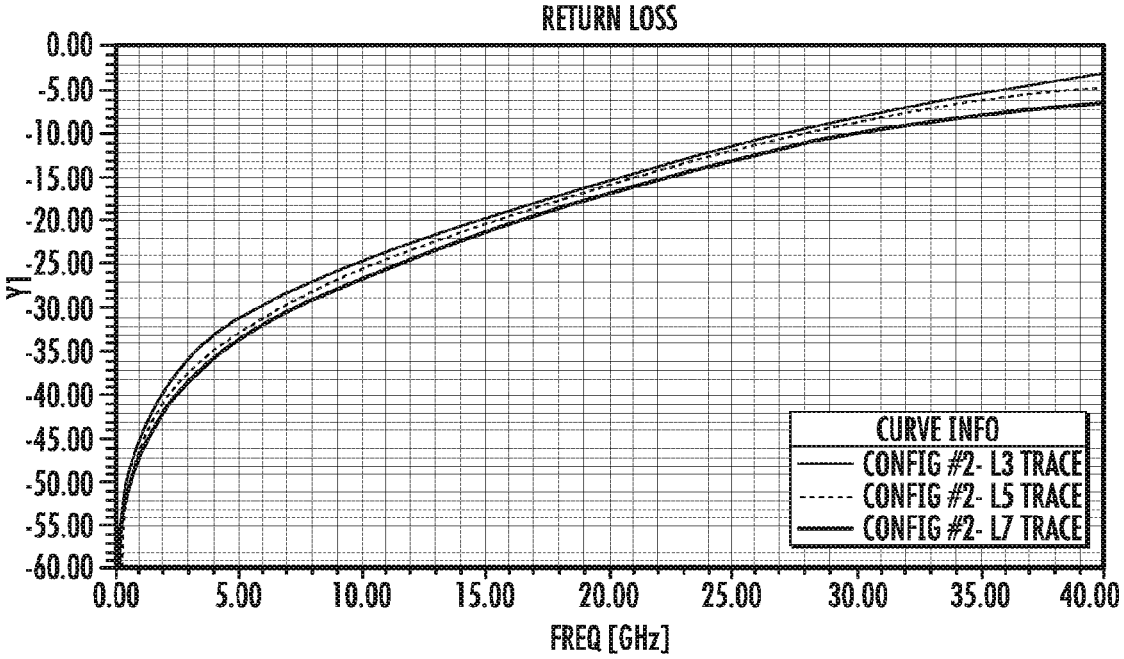
FIG. 14 illustrates a graph of return loss performance of the configurations depicted in FIG. 10, FIG. 11 and FIG. 12.
Figure 15:
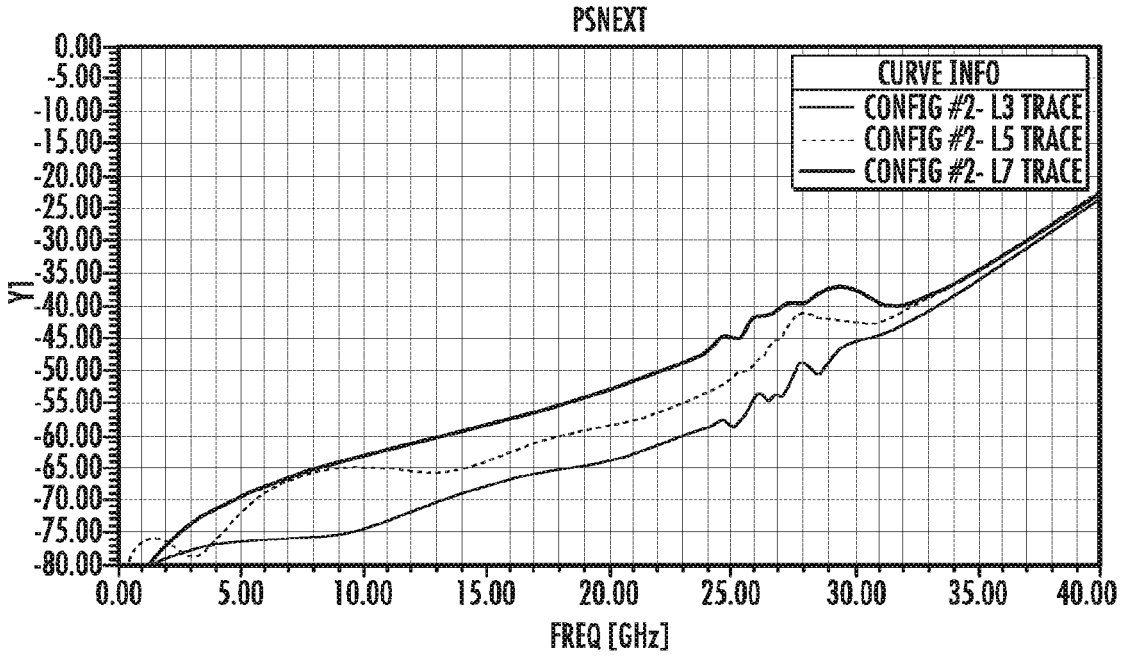
FIG. 15 illustrates a graph of near-end cross talk performance of the configurations depicted in FIG. 10, FIG. 11 and FIG. 12.
Figure 16:
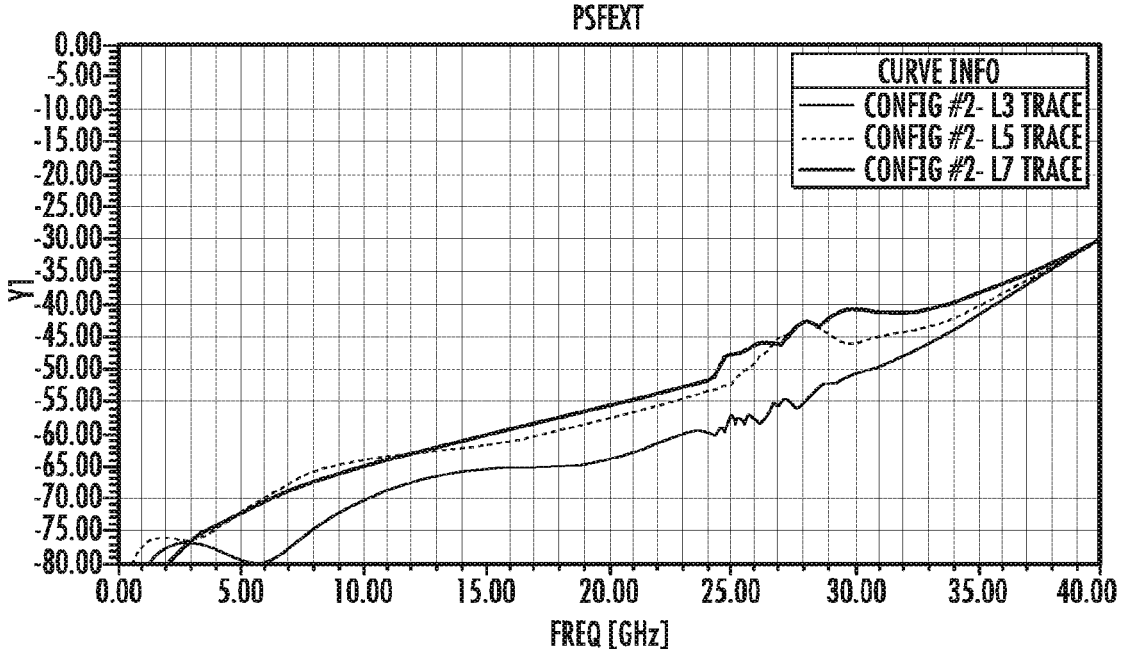
FIG. 16 illustrates a graph of far-end cross talk performance of the configurations depicted in FIG. 10, FIG. 11 and FIG. 12.
Figure 17:
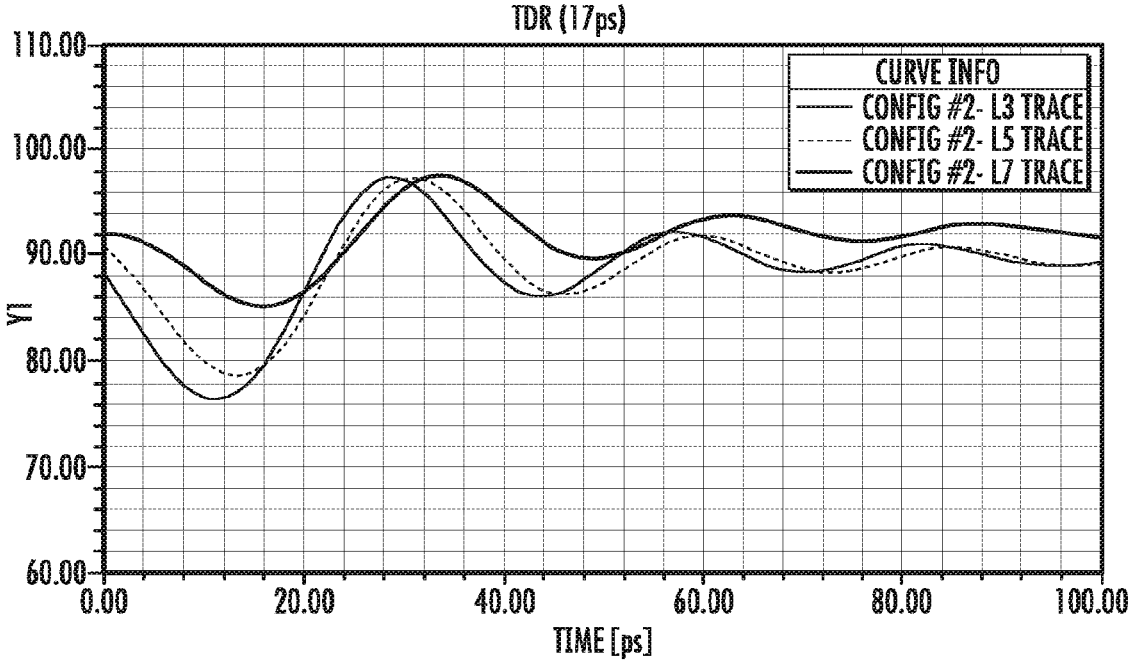
FIG. 17 illustrates a graph of impedance response of the configurations depicted in FIG. 10, FIG. 11 and FIG. 12.

FIGS. 10-17 illustrate the benefit of a connector with the modified signal tails. FIGS. 10-12 illustrate embodiments where the tails extend into the circuit board about 1.2-1.3 mm. FIG. 10 illustrates the configuration associated with Config #2, L3 trace; FIG. 11 illustrates the configuration associated with Config #2, L5 trace and FIG. 12 illustrates the configuration associated with Config #2, L7 trace. As can be appreciated, the signal terminal tail is the same in each configuration (e.g., the enlarged portion extends less than 0.5 mm in to the circuit board) but the board is backdrilled so that the distance V1 from the respective trace to the end of the via is kept constant at about 0.3 mm. As can be appreciated, this means that distance P1 is greater than distance P2 and distance P2 is greater than distance P3. In addition, the length of 270c is greater than the length of 270b, which in turn is great than the length of 270a (which is about 0.5 mm).

As the charts in FIGS. 13-17 illustrate, the new signal terminal design, in combination with a circuit board that is backdrilled so that the via extends about 0.3 mm past the trace, provides improved insertion loss and return loss as the via length increases but provides slightly worse cross talk as the via length increases. Thus the new signal tails can be utilized in a variety of configurations and in each situation the new signal tails provide desirable performance.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A connector system, comprising:

a circuit board with a top surface and a bottom surface and a plurality of signal traces positioned near the top surface, the circuit board having a plurality of ground vias and signal vias provided therein, the signal vias connected to the signal traces and being backdrilled to a length of about 0.3 mm from the corresponding signal trace; and a connector mounted on the top surface, the connector including:

a plurality of ground terminals supported by the housing, the ground terminals having a tail configured to extend more than 1.0 mm into the circuit board; and a plurality of signal terminals supported by the housing, the signal terminals each having a tail positioned in the signal vias, the signal tails having an enlarged portion that does not extend more than 0.5 mm into the circuit board.

2. The connector system of claim 1, wherein the enlarged portion of the ground terminals is positioned at least 0.2 mm into the circuit board.

3. The connector system of claim 2, wherein the enlarged portion is an eye-of-the-needle.

4. The connector system of claim 3, wherein the signal tails and the ground tails are substantially the same length.

5. The connector system of claim 3, wherein the signal tails and the ground tails extend into the circuit board about 1.3 mm.

6. The connector system of claim 5, wherein the signal tails and the ground tails are substantially the same length.

7. The connector system of claim 1, wherein the signal tails and the ground tails extend into the circuit board about 1.3 mm.

8. The connector system of claim 1, wherein the signal tails and the ground tails are substantially the same length.

9. The connector system of claim 1, wherein the backdrill diameter is at least about 0.7 mm.

* * * * *